United States Patent [19]

Lirette

[11] Patent Number: 4,951,324

[45] Date of Patent: Aug. 28, 1990

[54] TOILET SEAT AND LID LIFTER

[76] Inventor: Hewitt P. Lirette, Rte. 2, Box 678, Chauvin, La. 70344

[21] Appl. No.: 357,292

[22] Filed: May 26, 1989

Related U.S. Application Data

[63] Continuation-in-part of Ser. No. 146,474, Jan. 21, 1988, abandoned.

[51] Int. Cl.[5] ..... A47K 13/10

[52] U.S. Cl. ..... 4/251; 16/126; 220/263

[58] Field of Search ..... 4/251; 16/112, 126, 16/319; 220/262, 263, 264

[56] References Cited

U.S. PATENT DOCUMENTS

| | | | |
|---|---|---|---|
| 721,604 | 2/1903 | Raster | 220/263 |
| 1,082,277 | 12/1913 | Liberman | 220/263 X |
| 1,470,205 | 10/1923 | Vogt | 220/263 |
| 1,999,070 | 4/1935 | Svedelius | 4/251 |
| 1,999,555 | 4/1935 | Adams . | |
| 2,236,576 | 4/1941 | Loebner . | |
| 2,251,770 | 8/1941 | Warner . | |
| 2,549,572 | 4/1951 | Campanelli | 220/263 X |
| 3,417,411 | 12/1968 | Greenwood . | |
| 3,504,385 | 4/1970 | Fields | 4/251 |
| 4,534,073 | 8/1985 | Smith . | |
| 4,584,724 | 4/1986 | Wilson . | |
| 4,592,097 | 6/1986 | Zimmerman . | |

*Primary Examiner*—Charles E. Phillips

*Attorney, Agent, or Firm*—Fleit, Jacobson, Cohn, Price, Holman & Stern

[57] ABSTRACT

A structure to facilitate lifting a toilet seat and a toilet seat lid in a manner that will reduce contact with possible unsanitary surfaces and eliminate the necessity of bending over to grasp and lift the toilet seat and toilet seat lid. The lifter includes a pivotally supported handle structure mounted on the toilet seat and provided with an elongated rod generally paralleling the external edge of the toilet seat and provided with a pair of generally parallel outwardly extending forward and rearward rod-like structures at the end thereof thereby enabling a person to engage the forward rod-like structure with a knee and push it downwardly and rearwardly, thus causing the rearward rod-like structure to move upwardly and forwardly to provide a handle at an elevated position which can be grasped and moved upwardly by exerting a lifting force thereon thereby lifting the seat and seat lid when it is resting on the seat.

17 Claims, 2 Drawing Sheets

FIG. 1
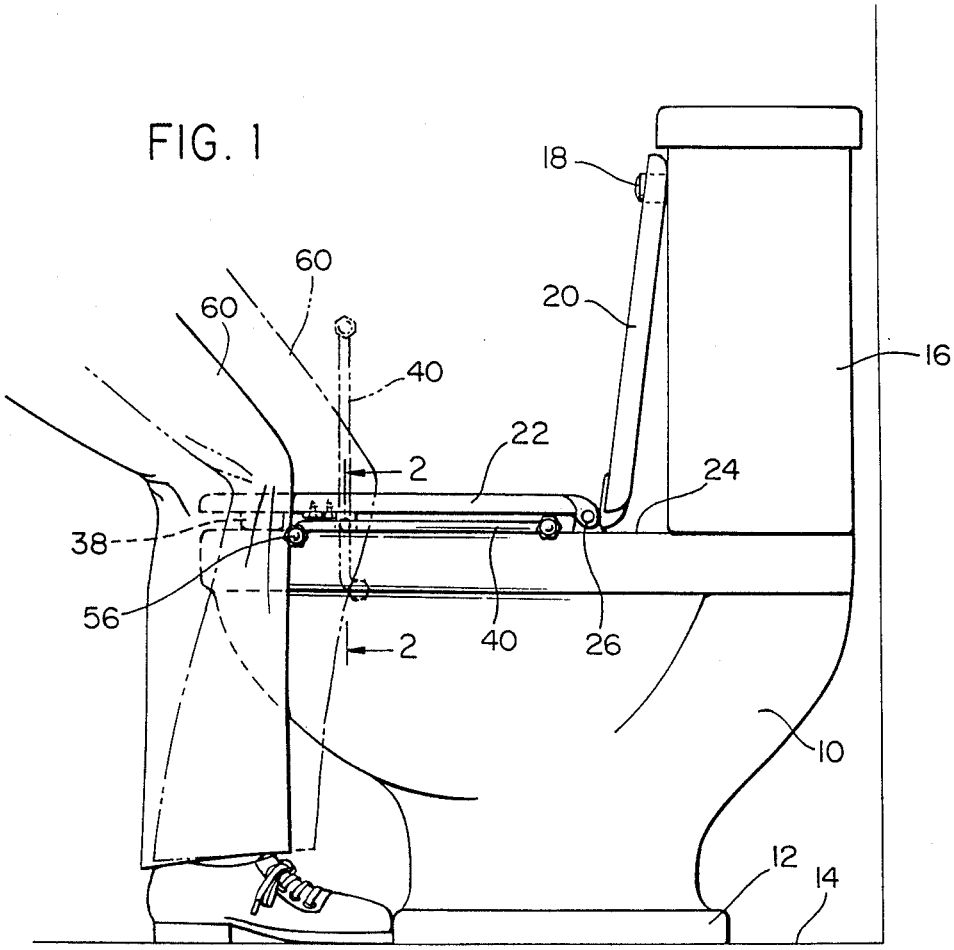
FIG. 3
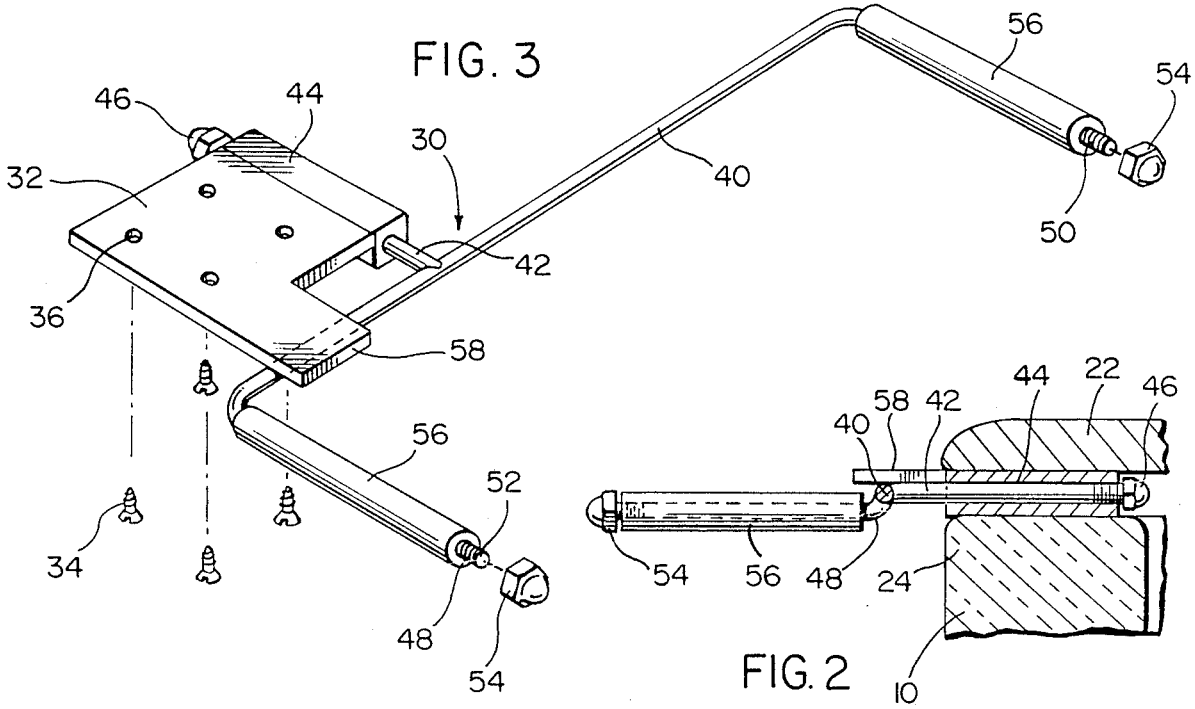
FIG. 2

TOILET SEAT AND LID LIFTER

CROSS-REFERENCE TO RELATED APPLICATION

This application is a continuation-in-part of copending application U.S. Ser. No. 07/146,474 filed Jan. 21, 1988 for Toilet Seat and Lid Lifter, now abandoned. The prior art cited in that application is incorporated herein by reference thereto.

BACKGROUND OF THE INVENTION

1. Field of the Invention

The present invention generally relates to a structure to facilitate lifting a toilet seat and a toilet seat lid in a manner that will reduce contact with possible unsanitary surfaces and eliminate the necessity of bending over to grasp and lift the toilet seat and toilet seat lid. The lifter includes a pivotally supported handle structure mounted on the toilet seat and provided with an elongated rod generally paralleling the external edge of the toilet seat and provided with a pair of generally parallel outwardly extending forward and rearward rod-like structures at each end thereof thereby enabling a person to engage the forward rod-like structure with a knee and push it downwardly and rearwardly, thus causing the rearward rod-like structure to move upwardly and forwardly to provide a handle at an elevated position which can be grasped and moved upwardly by exerting a lifting force thereon thereby lifting the seat and lid when it is resting on the seat.

2. Information Disclosure Statement

Various devices have been patented to facilitate the lifting of a toilet seat and/or toilet seat lid from a lowered closed position to an upwardly and rearwardly tilted open position. Such devices include rigid laterally extending handles as well as pedal operated linkage mechanisms by which the seat and/or lid can be lifted without coming into direct contact with the toilet seat or lid.

SUMMARY OF THE INVENTION

An object of the present invention is to provide a toilet seat and toilet seat lid lifter which can be easily secured to an existing toilet seat or lid and which will function effectively to provide a lifting handle for the seat and lid.

Another object of the invention is to provide a toilet seat and lid lifter in the form of a pivotal handle having an elongated rod-like structure provided with a pivotal connection intermediate its ends to a toilet seat with each end of the rod-like structure including a laterally outwardly extending rod which projects laterally outwardly from the side edge portion of the toilet seat so that a knee can be engaged with one of the laterally extending rods for moving the engaged rod downwardly and rearwardly, thus causing the other laterally extending rod to move upwardly and forwardly so that it can be easily grasped by a person desiring to lift the toilet seat and also the toilet seat lid if it is in closed relationship to the toilet seat and commode.

A further object of the invention is to provide a lifter in accordance with the preceding object in which the pivotal connection is provided by a socket drilled or otherwise formed in the side edge of the toilet seat which receives a rivet assembly extending through the rod-like structure with the inner end of the rivet assembly being enlarged to secure the lifter to the seat. An alternative structure includes a bracket attached to the undersurface of the toilet seat with the elongated rod-like structure having a laterally extending pivot rod mounted in the bracket for securing the elongated rod-like structure to the toilet seat.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of a conventional toilet illustrating one embodiment of the toilet seat and lid lifter of the present invention installed thereon.

FIG. 2 is a sectional view taken along section line 2—2 on FIG. 1 illustrating the specific structure of the bracket and pivotal support for the lifter.

FIG. 3 is a perspective view of the lifter illustrating the structural arrangement of the components prior to it being assembled to the undersurface of the toilet seat.

DESCRIPTION OF THE PREFERRED EMBODIMENTS

Figure 4:
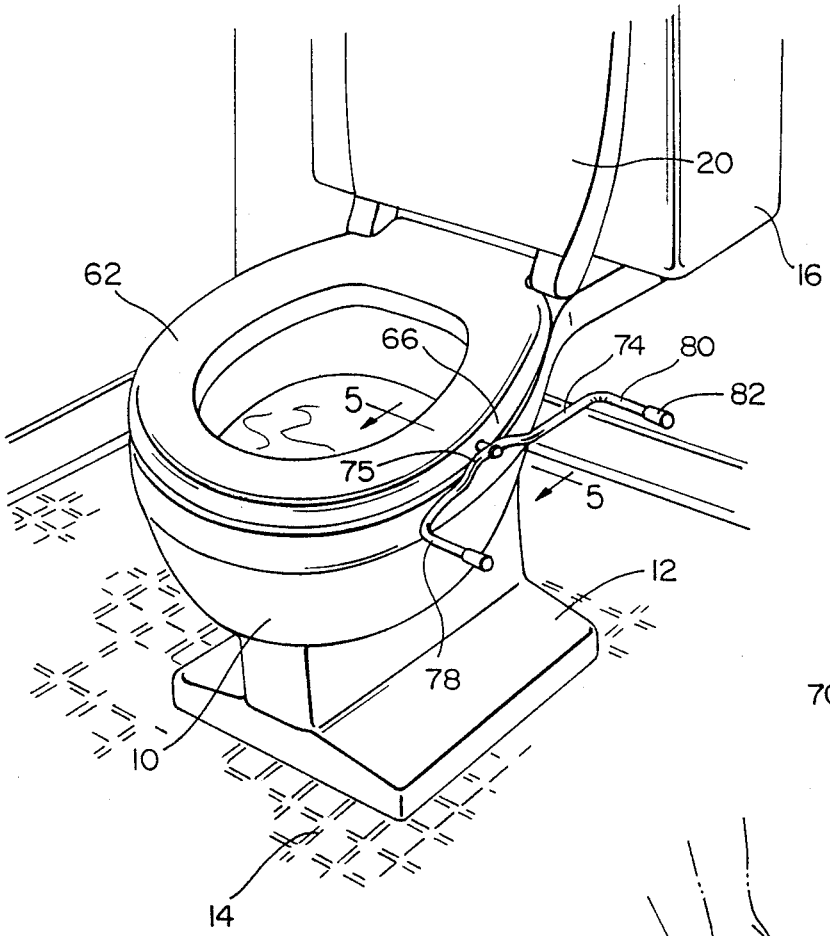
FIG. 4 is a perspective view of a toilet illustrating the preferred embodiment of toilet seat and lid lifter.
Figure 6:
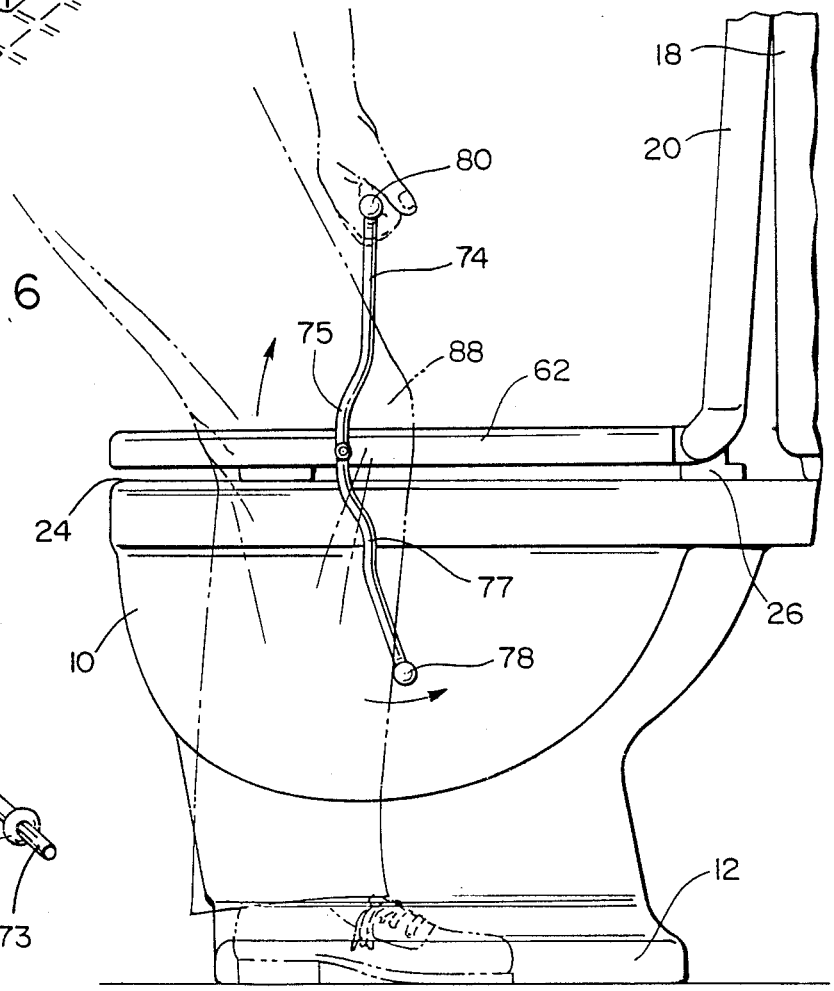
FIG. 6 is a side elevational view of the toilet with the lifter moved to vertical position.

Referring now specifically to the drawings, FIGS. 1, 4 and 6 illustrate a conventional toilet commode bowl 10 supported from a base 12 mounted on a floor surface 14 in a conventional manner with the commode bowl 10 including a flush tank 16 mounted thereon or the flush tank may be mounted on a wall surface or the like with these components being conventional as is a flush handle 18, a toilet seat lid 20 and a toilet seat 22 which are hingedly connected to the upper rim 24 of the commode bowl 10 by conventional hinge structure 26. All of the aforementioned structure of a conventional commode-type toilet is well-known.

FIG. 3 illustrates one embodiment of the lifter of the present invention that is generally designated by reference numeral 30 and which includes a mounting bracket 32 in the form of a flat plate secured to the undersurface of the toilet seat 22 by a plurality of screws 34 extending through holes 36 in the bracket 32. The holes 36 may be countersunk on the undersurface of the bracket 30 so that the heads of the screws will be flush with the undersurface of the bracket 32. The vertical thickness of the bracket 32 is such that it will fit under the seat 22 in the space normally provided between the lower surface of the seat 22 and the upper surface of the commode bowl rim 24 which is provided by the supporting members 38 on the undersurface of the seat 22 and the hinge structure 26 which is conventional structure for the toilet seat.

The lifter 30 includes an elongated rod-like handle 40 which is pivotally supported from the bracket 32 by a laterally extending support rod 42 that is perpendicular to the handle 40 and located generally in the central area of the length of the handle 40 but adjacent one end as compared to the other. The supporting rod 42 is pivotally received in a support bearing 44 that is integral with the bracket 32 and is held therein by a fastening nut 46 which may be a screw-on type fastening nut or a drive-on type acorn nut or the like so that when the support rod 42 is extended through the bearing 44, the nut 46 will retain the support rod 42 therein and enable pivotal movement of the handle 40 about the axis defined by the support rod 42. The outer ends of the elongated rod-type handle 40 are formed with laterally extending portions 48 and 50 with the laterally extending portions having threaded ends 52 each of which receives a retaining nut 54 and a tubular sleeve 56 is mounted on each of the laterally extending end portions 48 and 50 with the sleeve 56 being retained in position by the nut 54. The sleeve may be any type of resilient tubular material such as a plastic tube or the like and may be of any suitable color including a decorative color similar to or compatible with the color of the commode or other surface areas in the bathroom.

The bracket 32 is provided with a projecting stop lug 58 on one edge thereof which extends laterally outwardly into overlying relation to an end portion of the rod-like handle 40 as illustrated in FIG. 3 so that the rod-like handle 40 can only pivot in one direction, that is, with the laterally offset end portion 48 and the sleeve 56 thereon being moved downwardly from a generally horizontal position with the rod-like handle 40 generally paralleling the undersurface of the seat 22 to a position in which the laterally offset end portion 48 is swung downwardly and the laterally offset portion 50 is swung upwardly so that the handle 40 is generally in a vertical position. As illustrated in FIG. 1, this can be accomplished by the knee region 60 of a person desiring to elevate the seat bringing the knee into engagement with the tubular sleeve 56 on the laterally extending member 48 and moving it inwardly and downwardly in a natural flexing movement so that the laterally extending portion 50 will swing upwardly so that the hand then can be used to grasp the sleeve 56 on the laterally extending end portion 50 and the seat then can be lifted to an elevated position so that it swings past vertical position to an inclined position against the lid 20 if the lid is already resting against the tank 16 or if the lid 20 is also in closed position both the lid and seat can be lifted by exerting upward force on the uppermost laterally extending end portion 50 after the laterally extending end portion 48 has been engaged by the knee 60 and moved downwardly in a pivotal direction about a pivot axis defined by the support rod 42. This structure enables a person to lift the toilet seat and/or lid without direct contact of the hand with the seat and lid and without bending over to grasp the seat or lid which sometimes is quite difficult when the person using the commode is handicapped or has back problems or other conditions which prevent that person from leaning forward and downwardly to grasp the seat and lid. This also eliminates possible transfer of infectious germs and therefore reduces transmission of diseases which may occur due to direct hand contact with a toilet seat or toilet seat lid.

With the seat and/or lid in closed position, the present invention can be used by a person desiring to open and lift the lid and seat by the person engaging their knee with the laterally extending end portion 4 of the handle 40 which is disposed forwardly of and alongside the toilet seat as illustrated in FIGS. 1 and 2 and by moving the knee inwardly in a normal flexing condition, the laterally extending end portion 48 will be pivoted downwardly and inwardly about an axis defined by the support rod 42 that supports the handle from the undersurface of the seat 22. As this occurs, the laterally extending end portion 50 will swing upwardly and forwardly toward the person desiring to open the seat and lid so that the sleeve 56 on the end portion 50 can be grasped by the hand and the seat and/or lid can then be elevated from the closed horizontal position to a vertical position and leaned backwardly against the toilet flush tank 16. The laterally extending stop 58 retains the laterally extending portion 48 generally in alignment with the undersurface of the seat since the elongated portion of the handle 40 is inwardly of the pivot axis 42 that enables the handle 40 to always be positioned in generally horizontal position when the seat 22 is closed. When the handle 40 is pivoted during the opening movement, the stop lug 58 will engage the elongated portion of the handle 40 to prevent it from rotating past an angled position at which point the elongated portion of the handle 40 will come into contact with the surface of the lug 58 which projects into its path of movement. Thus, the lifting device 30 can be effectively used to elevate and lower the seat and lid without placing the hand into contact with either the seat or lid thereby greatly facilitating sanitary conditions and enabling handicapped persons to more effectively elevate a toilet seat when desired. This device is especially useful in public toilets where various individuals may use the toilet and in some instances desire to use the toilet for urination in which event is is desirable and sanitary to elevate the toilet seat so that the upper surface of the seat will not be soiled which results in an objectionable condition for subsequent users. The structure of the lifter is quite simple and it can be easily installed onto existing toilet structures without modification thereof with it only being necessary to secure the bracket 32 in position under the toilet seat 22 by using a suitable screwdriver or similar implement.

Figure 5:
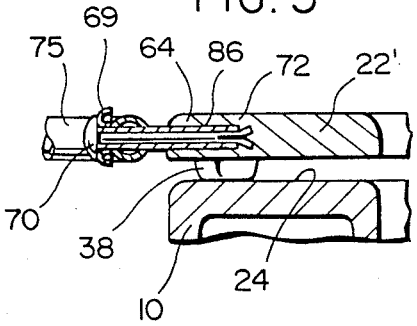
FIG. 5 is a sectional view taken along section line 5—5 on FIG. 4 illustrating the specific structure of pivotal connection with the seat.
Figure 7:
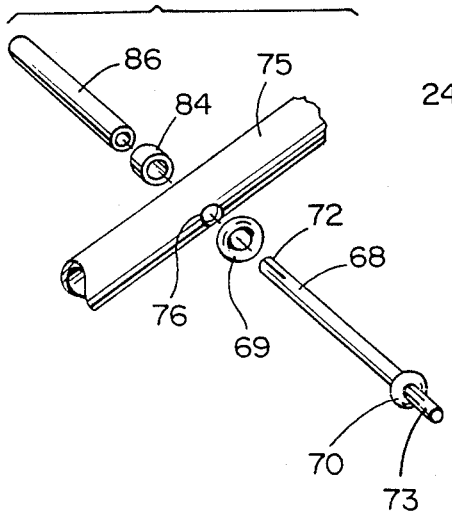
FIG. 7 is an exploded group perspective view of the rivet assembly and associated portion of the lifter.

FIGS. 4–7 disclose a preferred form of the invention in which the same reference numerals are utilized to designate the conventional commode components as are used in FIG. 1 of the drawings except that the seat is designated by reference numeral 62 and includes a laterally inwardly extending socket 64 drilled into the outer side edge 66 of the seat 62 as illustrated in FIG. 5. The socket 64 receives a pin rivet 68 which has a headed outer end 70 and an inner end 72 which will expand when the pin 73 which expands the inner end of the rivet 68 is struck on the outer end with the expanded inner end 72 being illustrated in FIG. 5. The rivet 68 pivotally mounts the elongated tubular rod-like handle 74 to the side edge 66 of the seat 62 with the rivet 68 extending through a diametrically extending aperture 76 in the handle 70 as illustrated in FIGS. 5 and 7. The rod-like handle 74 is provided with laterally extending ends 78 and 80 each of which may be provided with a cap 82 or, alternatively, a sleeve may be placed on the externally extending ends 78 and 80. The caps 82 are frictionally retained in place and may be constructed of plastic material of any suitable color. Also, the rod-like handle 74 may be of any suitable color to be compatible with the color of the commode or surfaces in the bathroom. A cylindrical spacer 84 is optionally provided between the inner surface of the handle 74 and the outer surface of the side edge 66 of the seat 62 with the spacer encircling the rivet 68 and spacing the handle 74 from the seat 62 as illustrated in FIG. 5. The socket 64 is also provided with a tubular sleeve 86 which closely receives the shank of the rivet 68 and extends to a point adjacent the bottom of the socket 64 with the outwardly flared end 72 extending beyond the sleeve 86. The sleeve 86 extends through the apertures 76 in handle 74 and engages a cap-type washer 69 positioned against the headed end 70 of rivet 68. The sleeve 86 extends between the rivet 68 and the interior of the socket 64 and along with the spacer may be constructed of metal or plastic. The spacer 84 assures that the handle 74 will not come into contact with any of the surfaces of the commode or seat during its pivotal movement from a generally horizontal position illustrated in FIG. 4 to its generally vertical position illustrated in FIG. 6. When moving the handle from the generally horizontal position of FIG. 4 to the position illustrated in FIG. 6, a user of the commode will bring his knee 88 into contact with the laterally extending end portion 78 at the forward end of the handle 70 and cause the laterally extending portion 78 to swing downwardly by a natural inward flexing of the knee 88 to move the handle 74 into the position illustrated in FIG. 6 thereby enabling the laterally extending end 80 to be grasped and lifted upwardly thereby lifting the seat 62 to an elevated position inclined toward the flush tank 18.

The operation of this embodiment is substantially the same as that embodiment illustrated in FIGS. 1–3 inasmuch as a person desiring to lift the seat and the lid if it is in closed position will approach the commode and engage their knee with the laterally extending rod 78 and by flexing the knee inwardly and downwardly the handle 74 will be pivoted from the horizontal position of FIG. 4 toward the vertical position in FIG. 6 thereby enabling the laterally offset end 80 to be grasped and pulled upwardly to lift the seat 62. Conversely, the seat may be lowered by grasping the laterally extending end 80 and pulling the handle and seat forwardly and downwardly to its horizontal position resting against the top surface of the commode.

This embodiment of the invention eliminates the stop structure shown in FIGS. 1–3 and in lieu of the bracket attached to the undersurface of the seat, the handle is pivotally attached by the rivet received in the drilled socket. Thus, the only tool that is needed to attach the lifter to an existing toilet seat is a drill to drill ¼" socket to a depth of 1" and a hammer to impact the outer end of the rivet pin 72 after installation to expand the inner end 72 of the rivet. The handle is counterbalanced with the shorter end being substantially equal in weight to the longer end in order that it will stay at rest in a horizontal position when the seat is down as illustrated in FIG. 4. Weight, such as fishing lure weights, may be added to the end of the handle 74 to balance the handle 74 in order for it to return to a horizontal position when released and the seat is lowered. As the handle is released, the person using the lifter may exert a rearward force on the offset end 80 which is positioned above the seat. The handle 74 includes an offset portion 75 in which aperture 76 is formed and the forwardly extending end of the handle 74 curves downwardly at 77 to assure that the handle will pivot downwardly at the front end when engaged by the knee 88 or shin bone of a person using the lifter. If desired, a bonding adhesive may be used to anchor the rivet and sleeve in place in installations where vandalism is likely to occur.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A lifter for a toilet seat and/or lid comprising a mounting bracket adapted to be supported in underlying relation to a toilet seat and secured thereto, an elongated handle having a laterally extending support journalled on the bracket with the support being intermediate the ends of the elongated handle, each end of the handle including a laterally extending end portion extending outwardly from the seat in generally perpendicular relation to the elongated handle on the side opposite the support and providing a structure by which the knee of a person desiring to lift the toilet seat can engage one of the laterally extending end portions and pivot it downwardly about the axis of the support and elevate the opposite laterally extending end portion to facilitate it being grasped by the person to enable the seat to be lifted without the person bending over to directly grasp the toilet seat.

2. The structure as defined in claim 1 wherein said support is offset on the elongated handle toward the end portion thereon for engagement with the knee to orient the elongated handle in generally horizontal position, said bracket including a stop lug engaging the elongated handle to limit its movement in one direction to orient the laterally extending end portion for engagement by the knee in a position for engagement by the knee during a normal inward flexing movement of the knee by a person using the lifter.

3. The structure as defined in claim 2 wherein said elongated handle is in the form of an elongated rod and each laterally extending end portion is a shorter continuation of the rod in perpendicular relation to the elongated rod.

4. The structure as defined in claim 3 wherein said bracket includes a tubular bearing along one edge thereof, said support being in the form of a rod journalled in the bracket for rotational movement about the axis of the support rod.

5. The structure as defined in claim 4 wherein each of said laterally offset end portions is provided with a tubular sleeve thereon of resilient material having appearance characteristics compatible with the toilet and bathroom.

6. The structure as defined in claim 2 wherein said stop lug on the bracket also prevents forward pivotal movement of the elongated handle past a predetermined position when the seat has been lifted whereby the handle can be used to move the seat from its rearward tilted position to a vertical position and then to a lowered position with the offset of the support then serving to orient the elongated handle generally parallel with the undersurface of the seat.

7. A lifter for a toilet seat and lid comprising an elongated handle having a lateral support extending from one end and intermediate the ends thereof, means pivotally supporting the elongated handle via said laterally extending support from the side edge of the seat, each end of the handle including a laterally extending end portion extending outwardly therefrom in generally perpendicular relation thereto and extending from the side opposite of the laterally extending support thereby providing a structure by which the knee of a person desiring to lift the toilet seat can engage one of the laterally extending end portions and pivot it downwardly about the axis defined by the pivotal support means and elevate the opposite laterally extending end portion to facilitate it being grasped by the person to enable the seat to be lifted without the person bending over to directly grasp the toilet seat.

8. The structure as defined in claim 7 wherein said means pivotally supporting the elongated handle includes a tubular socket in said seat with the tubular socket extending inwardly from the side edge of the seat, a pivot member extending through the elongated handle intermediate its ends and into the socket for mounting the handle pivotally to the seat.

9. The structure as defined in claim 8 wherein said pivot member is a pin rivet having a headed outer end and an inner end expandable to outwardly tapering configuration when the outer end of the pin is struck by an impact implement.

10. The structure as defined in claim 9 together with a sleeve mounted on the rivet and extending from the expanded end of the rivet through the handle and being securely mounted within the socket to mount the rivet and handle to the seat.

11. In combination with a toilet seat pivotally supported from the top portion of a commode bowl, a handle structure mounted on said seat for manually lifting the seat to an elevated position, said handle structure including an elongated rigid member, said elongated member having a laterally extending member at each end thereof and extending to the same side of the elongated member, and means intermediate the ends of said elongated member for pivotally supporting the elongated member from said seat with the elongated member positioned alongside the seat and oriented generally horizontally with one laterally extending member being oriented in position for engagement by the knee of a person facing the commode bowl whereby inward movement of the knee moving said one laterally extending member downwardly and inwardly while the other laterally extending member will be caused to move upwardly and outwardly to serve as a handle for manual grasping and exerting upward force thereon to lift the seat.

12. The combination as defined in claim 11 wherein said means supporting the elongated member from the seat includes a laterally extending support member extending from said elongated member from the side opposite from the laterally extending members at the ends of the elongated member, and means pivotally supporting said support member from the seat.

13. The combination as defined in claim 11 wherein said seat and elongated member includes means retaining the elongated member in horizontal position until inward and downward force is exerted on said one laterally extending member by flexing the knee inwardly.

14. The combination as defined in claim 11 wherein said means pivotally supporting the elongated member from said seat includes an inwardly extending socket formed in the side edge of said seat, a pin rivet extending through the elongated member and into the socket for pivotally mounting the elongated member to the seat member.

15. The combination as defined in claim 14 wherein said rivet is a pin rivet having a headed outer end and an inner end expanded to outwardly tapering configuration by impact blows on the pin.

16. The combination as defined in claim 15 together with a sleeve mounted on the rivet outwardly of the outwardly tapering end of the rivet and extending through the elongated member for securely mounting the rivet in the socket thereby securely mounting the elongated member to the seat.

17. The combination as defined in claim 11 wherein said elongated member includes an offset portion intermediate the ends thereof, said offset portion receiving said pin rivet and sleeve, the forward end of said elongated member curving downwardly.

* * * * *